United States Patent [19]

Cha et al.

[11] 4,150,722

[45] Apr. 24, 1979

[54] DETERMINING THE LOCUS OF A RETORTING ZONE IN AN OIL SHALE RETORT BY RATE OF SHALE OIL PRODUCTION

[75] Inventors: Chang Y. Cha, Bakersfield, Calif.; William J. Bartel, Grand Junction, Colo.

[73] Assignee: Occidental Oil Shale, Inc., Grand Junction, Colo.

[21] Appl. No.: 885,118

[22] Filed: Mar. 10, 1978

[51] Int. Cl.[2] ..... E21B 43/24; E21B 43/26; E21B 47/00

[52] U.S. Cl. ..... 166/251; 166/259; 299/2

[58] Field of Search ..... 166/251, 250, 256, 259-261; 299/2, 4, 5, 13

[56] References Cited

U.S. PATENT DOCUMENTS

| | | | |
|---|---|---|---|
| 3,001,776 | 9/1961 | van Poollen | 299/2 |
| 3,031,762 | 5/1962 | Parker | 166/251 X |
| 3,467,189 | 9/1969 | Dingley | 166/251 |
| 3,483,730 | 12/1969 | Gilchrist et al. | 166/251 X |
| 3,586,377 | 6/1971 | Ellington | 299/2 X |
| 3,661,423 | 5/1972 | Garrett | 299/2 |
| 4,082,145 | 4/1978 | Elkington | 299/2 X |

OTHER PUBLICATIONS van Poollen, "Transient Tests Find Fire Front in an in Situ-Combustion Project", *The Oil and Gas Journal*, vol. 63, No. 5, Feb. 1, 1965, pp. 78, 79 and 80.

*Primary Examiner*—Stephen J. Novosad
*Attorney, Agent, or Firm*—Christie, Parker & Hale

[57] ABSTRACT

A retorting zone advances through a fragmented permeable mass of particles containing oil shale in an in situ oil shale retort in a subterranean formation containing oil shale. The fragmented mass comprises layers of formation particles of differing kerogen content corresponding to strata of differing kerogen content in the subterranean formation. The retorting zone advances in a direction substantially perpendicular to such layers in the fragmented mass. Kerogen in oil shale in the retorting zone is decomposed to produce gaseous and liquid products including shale oil, and shale oil is withdrawn from the fragmented mass. The rate of shale oil production in the retort depends upon th kerogen content of such a layer in such a fragmented mass through which the retorting zone advances. To determine the locus of the retorting zone with respect to such layers in the fragmented mass, formation is assayed for kerogen content for defining the locus of at least one such layer in the fragmented mass before retorting, and the rate of shale oil production from the retort is monitored. The locus of the combustion zone can be estimated from the locus of the retorting zone so determined.

20 Claims, 6 Drawing Figures

RETORT
INLET
MIXTURE

17
COMBUSTION
ZONE
RETORTING ZONE
14
10
16
12
20
24
OFF GAS
23
LIQUID
PRODUCTS
22

DETERMINING THE LOCUS OF A RETORTING ZONE IN AN OIL SHALE RETORT BY RATE OF SHALE OIL PRODUCTION

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit and including dolomite with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of any oxygen containing retort inlet mixture into the retort as an oxygen supplying gaseous combustion zone feed to advance the combustion zone through the retort. In the combustion zone, oxygen in the combustion zone feed is depleted by reaction with hot carbonaceous materials to produce heat, combustion gas, and combusted oil shale. Temperatures are attained in the combustion zone sufficiently high to decompose carbonates of alkaline earth metals in oil shale to the corresponding oxides of alkaline earth metals. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature, it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

As used herein, the term "retorting gas" is used to indicate gas which serves to advance a retorting zone through the fragmented mass in an in situ oil shale retort. Retorting gas includes, but is not limited to, an oxygen supplying gas introduced into a retort for advancing a combustion zone and retorting zone through a retort and a hot retorting gas such as steam which can be introduced into a retort, or generated in a combustion zone in a retort for advancing a retorting zone through a retort.

There are several reasons that it is desirable to know the locus of parts of the combustion and retorting processing zones as they advance through an in situ oil shale retort. One reason is that by knowing the locus of the retorting zone, steps can be taken to control the orientation or shape of the retorting zone, for example by controlling the orientation or shape of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed or warped combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed can be varied with variations in the kerogen content of oil shale being retorted. Formation containing oil shale includes horizontal strata or beds of varying kerogen content, including strata containing substantially no kerogen, and strata having a Fischer assay of 80 gallons of shale oil per ton of oil shale. If combustion zone feed containing too high a concentration of oxygen is introduced into a region of the retort containing oil shale having a high kerogen content, oxidation of carbonaceous material in the oil shale can generate so much heat that fusion of the oil shale can result, thereby producing a region of the fragmented mass which cannot be penetrated by retorting gases.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

SUMMARY OF THE INVENTION

The present invention concerns a process for determining the locus of a retorting zone advancing through a fragmented permeable mass of formation particles in an in situ oil shale retort in a subterranean formation containing oil shale, the fragmented mass having layers of formation particles of differing composition corresponding to strata of differing composition in the formation. The retort has liquid product passing therefrom, the liquid product containing shale oil formed from kerogen contained in the formation by advancement of the retorting zone through the fragmented mass. The method of the present invention comprises determining content of kerogen in the formation at selected locations in the retort before retorting for defining the locus of at least one such layer in the fragmented mass and monitoring production rate of shale oil from the retort for determining the locus of the retorting zone with respect to such a layer in the fragmented mass.

According to the present invention, the locus of the retorting zone can be determined by monitoring production rate of shale oil from the fragmented mass. The locus of a combustion zone can be estimated from the known locus of the retorting zone.

DRAWINGS

These and other features, aspects and advantages of the present invention will become more apparent upon consideration of the following description, appended claims, and accompanying drawings where:

Figure 1:
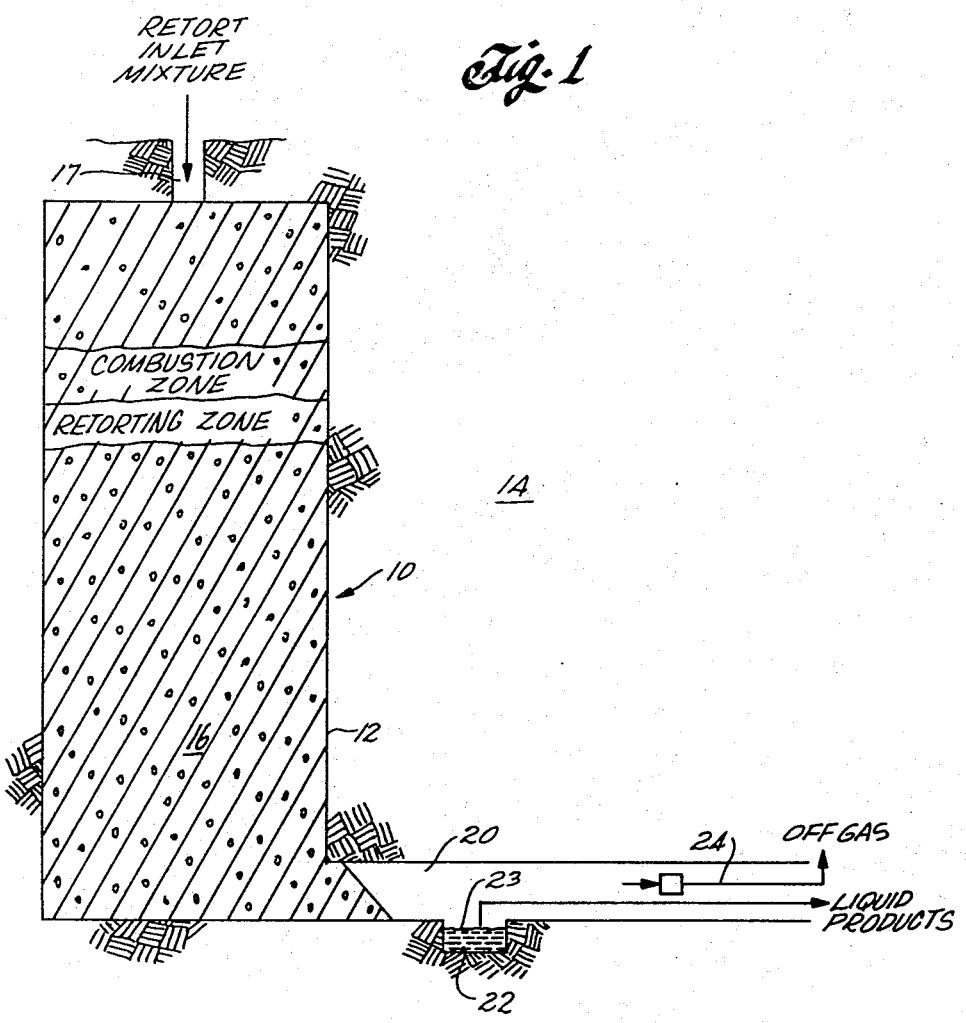
FIG. 1 represents schematically in vertical cross-section an in situ oil shale retort.
Figure 4:
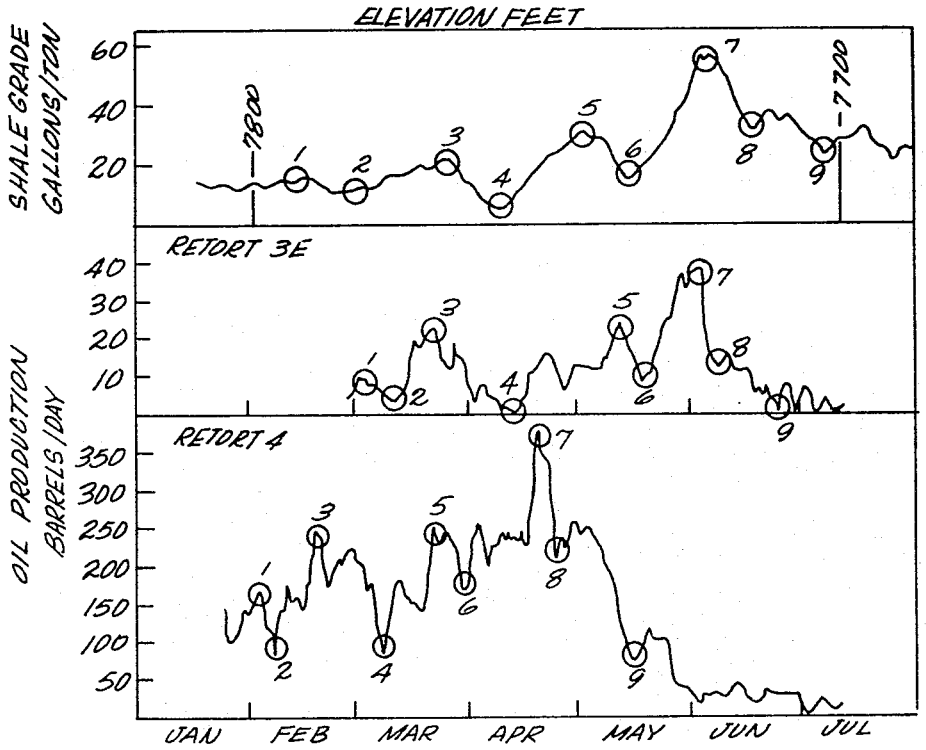
FIG. 4 shows an empirical correlation of shale oil grade as a function of elevation in subterranean formation with actual daily shale oil production rates from two in situ oil shale retorts having corresponding layers of formation particles.
Figure 5:
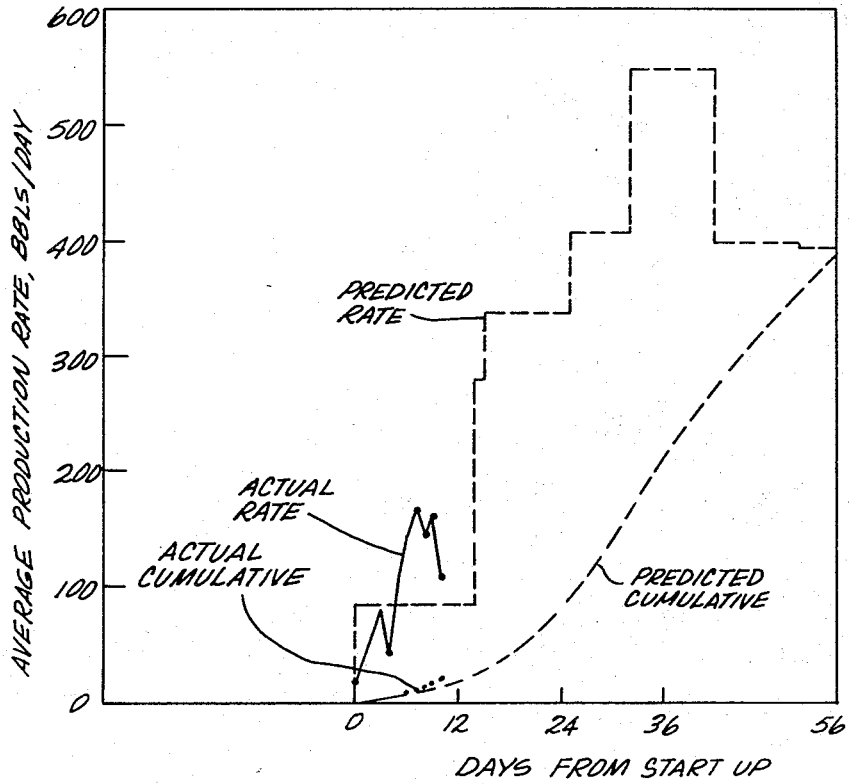
Figure 6:
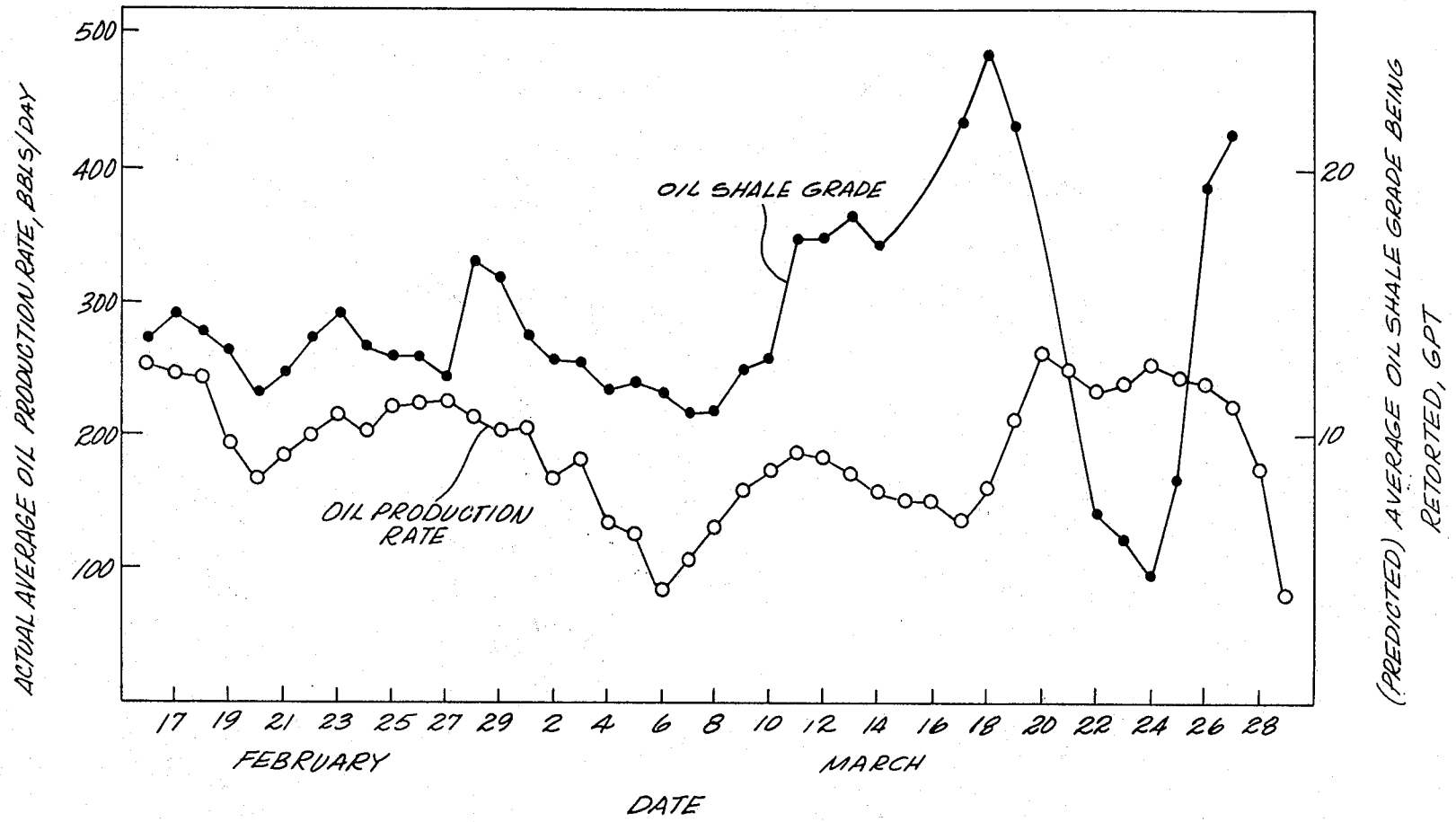

FIG. 5 shows partial curves for predicted and actual shale oil production rates for another retort like that of FIG. 1, the actual data revealing a problem occuring early in the retorting operation; and FIG. 6 is an expanded section of the actual shale oil production rate curve for Retort 4 of FIG. 4 as a function of time from start up correlated with the predicted grade of oil shale being retorted, assuming the retorting zone is substantially flat and horizontal.

DESCRIPTION

Referring to FIG. 1, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void.

The fragmented permeable mass in the retort can have a void fraction of from about 10 to about 30%. By void fraction, there is meant the ratio of the volume of voids or spaces between particles in the fragmented mass to the total volume of the fragmented permeable mass of particles in the retort.

A conduit 17 communicates with the top of the fragmented mass of formation particles. During the retorting operation of the retort 10, a combustion processing zone is established in the retort by ignition of carbonaceous material in oil shale. The combustion zone is advanced through the fragmented mass by introducing an oxygen containing retort inlet mixture into the in situ oil shale retort through the conduit 17 as a combustion zone feed. The retort inlet mixture can be air, or air enriched with oxygen, or air diluted by a fluid such as water, steam, a fuel, recycled off gas, an inert gas such as nitrogen, and combinations thereof. Oxygen introduced to the retort in the retort inlet mixture oxidizes carbonaceous material in the oil shale to produce combustion gas. The combustion processing zone is the portion of the retort where the greater part of the oxygen in the combustion zone feed that reacts with residual carbonaceous material in retorted oil shale is consumed. Heat from the exothermic oxidation reactions, carried by flowing gases, advances the combustion zone through the fragmented mass of particles.

Combustion gas produced in the combustion zone and any unreacted portion of the combustion zone feed pass through the fragmented mass of particles on the advancing side of the combustion zone to establish a retorting processing zone on the advancing side of the combustion zone. Kerogen in the oil shale is retorted in the retorting zone to produce gaseous and liquid products including shale oil.

There is an access tunnel, adit, drift 20 or the like in communication with the bottom of the retort. The drift contains a sump 22 in which liquid products 23, including shale oil and water, are collected to be withdrawn. An off gas 24 containing gaseous products, combustion gas, carbon dioxide from carbonate decomposition, and any gaseous unreacted portion of the combustion zone feed, is also withdrawn from the in situ oil shale retort 10 by way of the drift 20. The liquid products and off gas are withdrawn from the retort as effluent fluids.

In the western United States oil shale is often horizontally bedded in strata of differing kerogen content due to the sedimentary nature of oil shale. Layers of formation particles in the fragmented mass correspond to strata in the unfragmented formation because there is little vertical mixing between strata when formation is explosively fragmented. Therefore, samples of various strata through the retort can be taken before initiating retorting of the oil shale and assays can be conducted to determine content of kerogen in such layers in the fragmented mass. Such samples can be taken from within the fragmented mass, from formation in the retort site before expansion, or from formation nearby the fragmented mass since little change in kerogen content of a stratum of formation occurs over large areas of formation.

Liquid products withdrawn from the fragmented mass can include a water phase, a shale oil phase and an emulsion of shale oil and water. The volume of shale oil in such a shale oil phase can be measured directly. The volume of shale oil in such an emulsion can be measured by first breaking the emulsion to form separated water and shale oil, and measuring the volume of separated shale oil. A technique for separating shale oil and water from such an emulsion is described in U.S. Pat. Application Ser. No. 871,368 entitled "Method of Breaking Shale Oil-Water Emulsion" filed Jan. 23, 1978, by Leslie E. Compton, assigned to the assignee of the present application, and incorporated herein by this reference. Another technique for breaking such emulsion is described in U.S. Pat. application Ser. No. 737,556, filed Jan. 11, 1976, now U.S. Pat. No. 4,109,718 by Robert S. Burton, III, assigned to the assignee of the present application, and incorporated herein by this reference. Alternatively, the quantity of shale oil in such an emulsion can be determined by measuring the volume of emulsion and the concentration of shale oil in the emulsion. From the foregoing measurements, the total production rate of shale oil from the fragmented mass can readily be determined. It can be convenient to determine the production rate of shale oil in terms of barrels per day.

Figure 2:
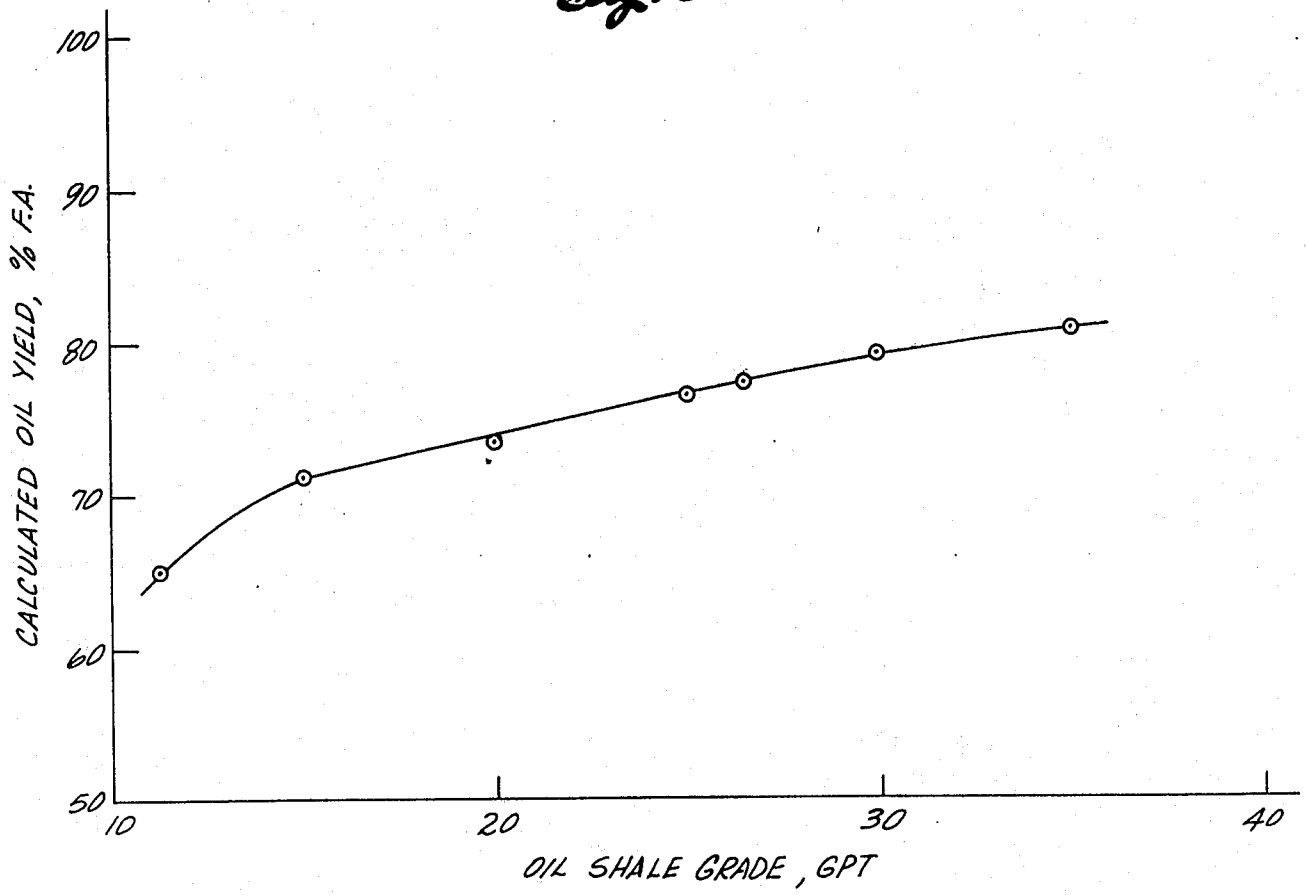
FIG. 2 shows predicted yield of shale oil as a function of oil shale grade for an in situ oil shale retort like that of FIG. 1.

By monitoring production rate of shale oil, it is possible to determine the content of kerogen in a layer of formation particles being retorted. This is because the production rate of shale oil withdrawn from an in situ oil shale retort can be correlated with the content of kerogen in the oil shale being retorted. FIG. 2 is a graph of predicted yield of shale oil from an in situ oil shale retort as of function of the Fischer assay, wherein a sample customarily weighing 100 grams and representing one foot of core is subjected to controlled laboratory analysis involving grinding the sample into small particles. The ground sample is then heated in a sealed vessel at a known rate of temperature rise to measure kerogen content which is stated in gallons per ton referring to the number of gallons of shale oil recoverable from one ton of oil shale when heated in the same manner as in the Fischer assay.

The Fischer assay of oil shale is not a direct measure of the yield of shale oil produced by advancement of a combustion zone and a retorting zone through a fragmented permeable mass of formation particles in an in situ oil shale retort because some shale oil can be burned in the combustion zone for supplying heat to the retorting zone. The relationship between predicted yield of shale oil from such an in situ oil shale retort and Fischer assay is not linear. Thus, for example, when oil shale having a Fischer assay of about 10 gallons per ton or lower is retorted in such an in situ oil shale retort, the yield of shale oil from the retort can be essentially zero due to burning of products.

The kerogen content of a core sample of formation containing oil shale can also be measured optically. Such a method and apparatus therefore are described in U.S. Pat. application Ser. No. 764,859, filed Feb. 2, 1977, by Randall T. Chew, III, and assigned to the assignee of the present application. Said application No. 764,859 is incorporated herein by this reference.

As used herein, the term "content" is used to refer to the total amount or the concentration of kerogen in the formation.

The correlation between production rate of shale oil from an in situ oil shale retort and the kerogen content or Fischer assay of formation in the retort can be affected by factors which effect the yield of shale oil from a given grade of oil shale, including the size and design of the retort, the void fraction, changes in the manner of operating the retort, such as changes in the temperature, composition or gas velocity of a combustion zone feed and changes in the retorting zone temperature. The correlation depicted in FIG. 2 is thus representative of the kind of correlation that can be made. Such a correlation can be made by calculation or by emperical techniques. By retorting samples of formation containing oil shale under conditions simulating or reproducing the conditions encountered in operation of a particular retort or series of retorts, a correlation curve like that of FIG. 2 can be plotted for any type of in situ oil shale retort and for any combination of operation conditions.

To take advantage of such a correlation, formation at selected elevations is assayed for content of kerogen to develop a chart or histogram of kerogen content as a function of elevation in the fragmented mass. As noted above, layers of formation particles in the fragmented mass correspond to strata in the unfragmented formation because there is little vertical mixing between strata when formation is explosively expanded to form a fragmented permeable mass of formation particles. Therefore, samples of various strata in the formation can be taken and assays can be conducted to determine the kerogen content at selected elevations in the retort. From the samples and the correlation between production rate of shale oil and the kerogen content in the formation, the production rate of shale oil can be predicted as a function of the elevation of the retorting zone in the fragmented mass.

To determine the elevation of a retorting zone in an in situ oil shale retort for which a correlation of oil shale grade with elevation in the retort, a correlation of oil shale grade with shale oil production rate, and a prediction of shale oil production rate as a function of elevation of the retorting zone in the retort have been made as described above, the actual production rate of shale oil from the retort is measured, and the actual production rate and the predicted production rate are compared. From the comparison of actual and predicted production rates, the correlation of production rate with oil shale grade, and the correlation of oil shale grade with elevation in the retort, the elevation of the retorting zone in the retort can be determined.

Alternatively, cumulative production as a function of time can be measured and compared with predicted cumulative production.

Figure 3:
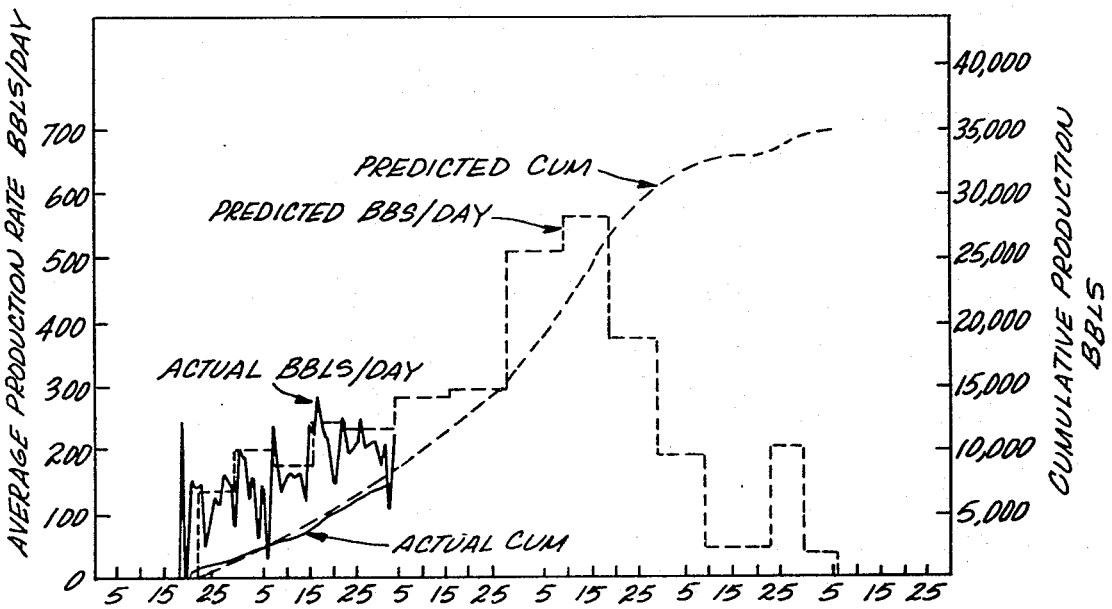
FIG. 3 shows actual and predicted production rates of shale oil and actual and predicted cumulative total production of shale oil for an in situ oil shale retort like that of FIG. 1.

The production rate of shale oil from an in situ oil shale retort as retorting progresses can be predicted for each day from start-up. This is done by estimating the advancement rate of the retorting zone through the retort. By predicting the production rate of shale oil as a function of the elevation of the retorting zone, and by estimating the rate of advancement of the retorting zone through the retort, the production rate of shale oil as a function of time from start-up can be predicted. In addition, the cumulative production of shale oil from the retort can be predicted for each day from start-up. FIG. 3 shows predicted and actual production rates and cumulative production of shale oil from the above-mentioned Retort 4.

The locus of a retorting zone in a fragmented permeable mass can also be determined by a graphical technique that depends upon a correlation of similarities between the shape of a graph or histogram of oil shale grade or kerogen content as a function of elevation in the fragmented mass in a retort and the shape of a graph of actual shale oil production. FIG. 4 shows such a correlation between (a) peaks and troughs, or intermediate maxima and minima, of graphs of actual shale oil production rates from two in situ oil shale retorts, identified as Retort 3E and Retort 4, and (b) corresponding peaks and troughs, or intermediate maxima and minima, of a graph of oil shale grade in gallons per ton (Fischer assay) as a function of elevation within the retorts. Corresponding peaks or troughs in the three graphs are identified by the same reference numeral. The shale oil production rates were measured daily and plotted as three day averages (production of a given day was averaged with that of the preceding day and the succeeding day). The differences in shale oil production rate between Retorts 3E and 4 is attributable at least in part to the difference in size of the retorts as well as retort operating conditions. Retort 3E had a horizontal cross-sectional area of about 1000 square feet while Retort 4 had an area of about 14,000 square feet. The graphs of daily shale oil production rate for both retorts correspond closely in overall shape to the graph of oil shale grade.

Thus, the locus of a retorting zone in a fragmented permeable mass of formation particles in such an in situ oil shale retort can be determined with respect to layers of formation particles of differing kerogen content in such a fragmented mass by assaying formation for kerogen content for defining the locus of a plurality of such layers in the fragmented mass and monitoring the production rate of shale oil withdrawn from such a retort for variation corresponding to advancement of a retorting zone through such layers of formation particles in the fragmented mass. The production rate of shale oil is monitored as a function of time and variations in such production rate as a function of time are correlated with variations in oil shale grade as a function of elevation in the retort.

There is a time delay between retorting of a particular layer of formation particles in an in situ oil shale retort and the appearance at the bottom of the retort of shale oil retorted from that layer. The length of the time delay depends upon the elevation of the retorting zone in the retort. An in situ oil shale retort as contemplated herein can be a few hundred feet high. Shale oil retorted from layers of formation particles high in the fragmented mass in the retort can take days to percolate downwardly through the fragmented mass to the bottom of the retort. Moreover, some of the shale oil produced initially wets particles in the fragmented mass on the advancing side of the retorting zone and does not appear at the bottom of the retort until later. Once the fragmented mass is wetted, this effect is of less significance. As the retorting zone approaches the bottom of the retort, the time delay decreases. In comparing actual and predicted production rates of shale oil and in correlating a graph of actual production rate of shale oil with a graph of oil shale grade as a function of elevation in the retort, the time delay is taken into account.

By comparing predicted production rate of shale oil with actual production rate of shale oil as retorting progresses, and/or by comparing actual cumulative production versus predicted cummulative production, it is possible to determine if the retorting zone has deviated from its predicted rate of advancement through the fragmented mass. FIG. 5 is discussed in more detail in Example 1 and shows how such a deviation can be detected.

Not only can the method of this invention be used for determining the elevation of a retorting zone in a fragmented permeable mass in a retort and for detecting deviations from a desired or predicted elevation, it can also be used to determine deviations of the retorting zone from a flat and horizontal orientation. If a retorting zone is substantially flat and horizontal, it encounters layers of formation particles of differing kerogen content relatively abruptly, and changes in production rate of shale oil can clearly be associated with changes in kerogen content. If the retorting zone is significantly skewed or warped, it can encounter several layers of differing kerogen content at substantially the same time, thereby tending to obscure the correlation between production rate of shale oil and the location of the retorting zone in the fragmented mass. In essence, the first derivative of the production rate of shale oil as a function of time of retorting is reduced when the retorting zone is skewed or non-planar as compared with the first derivative of the production rate of shale oil when the retorting zone is substantially flat and horizontal. Thus, it is possible to determine if the retorting zone is substantially planar and substantially normal to its direction of advancement by comparing the first derivative of determined production rate of shale oil with the first derivative of predicted production rate of shale oil.

In summary, by monitoring the production rate of shale oil produced in the retort, one can determine not only the location of the retorting zone in the retort, but also deviations of the retorting zone from its desired shape or orientation.

A reasonably good correlation between kerogen content of oil shale and production rate of shale oil has been developed. Formation is usually assayed for kerogen content before preparing an in situ oil shale retort regardless of any need to determine th locus of the processing zone, for example, for determining inlet gas conditions and making sure that the formation contains sufficient recoverable kerogen to justify the cost of forming and processing a retort. In addition, production rate of shale oil can be routinely monitored. Therefore, determing the locus of a retorting zone in accordance with this invention results in little, if any, additional cost.

The following examples demonstrates a method embodying features of this invention:

EXAMPLE 1

A retort was formed in the south-southwest portion of the Piceance Creek Basin of Colorado. The retort contained a fragmented permeable mass of formation particles which was formed by explosively expanding formation toward a vertically extending void. The fragmented mass had an average void fraction of about 17%. The fragmented mass was square with side dimensions of about 118 feet and was about 165–200 feet high with a sloping bottom boundary. The oil shale in the fragmented mass was in horizontal strata, i.e., the fragmented mass comprised horizontal layers, the oil shale within each layer having about the same kerogen content.

Before forming the fragmented permeable mass, core samples of formation were taken and analyzed for kerogen content by Fischer assay, and a correlation of oil shale grade with elevation in the retort was made. Production rate of shale oil as a function of oil shale grade was projected for this retort, and the result is presented in FIG. 2. This projection was based on a retort inlet mixture of 70% air and 30% steam introduced to the retort at a rate of 0.62 SCFM (standard cubic foot per minute) per square foot cross-sectional area of the fragmented mass. It was estimated that the retorting zone would advance through the fragmented permeable mass at an average rate of a little greater than 1 foot per day.

Based on the predicted retorting zone location and the correlation of oil shale grade with elevation, and the projected production of shale oil as a function of oil shale grade as shown in FIG. 2, the production rate of shale oil from the retort was predicted as a function of days from start-up, and is also presented in FIG. 5.

A combustion zone was established in the fragmented mass using liquefied petroleum gas as a fuel. Once the combustion zone was established, introduction of fuel was stopped. The combustion zone was advanced downwardly through the fragmented mass using a retort inlet mixture consisting of 70% air and 30% steam at a volumetric flow rate of about 0.62 SCFM per square foot of cross-sectional area of the fragmented permeable mass. The actual production rate of shale oil from the retort was monitored, and is plotted in FIG. 5.

As shown in FIG. 5, the measured production rate of shale oil was higher than the predicted production rate from about day 5 after start-up through about day 10 from start-up. It is believed that this was caused by gas flow channeling in the retort, where the combustion and retorting zones advanced in one region of the retort rather rapidly while advancing more slowly in other regions. Thus, the retorting zone was in the shape of a spike or wedge, for example, extending in part into a region of rich oil shale in the fragmented mass about 50 feet below the top of the fragmented mass. In other words, the retorting zone was not planar, and a portion of it had advanced by about the 7th day from start-up to an elevation in the fragmented mass to which it should not have advanced until much later.

This conclusion was reinforced by the temperature of the off gas, which was higher than predicted. Therefore, corrective measures were taken to establish a substantially flat retorting zone.

EXAMPLE 2

FIG. 6 shows an expanded section, covering 42 days, of the actual three day average shale oil product rate curve for Retort 4 of FIG. 4 correlated with the predicted grade of oil shale being retorted. The predicted locus of the retorting zone was calculated from the theoretical combustion zone feed on the assumption that the combustion zone and the retorting zone were substantially flat and horizontal. The known oil shale grade for the calculated locus of the retorting zone was plotted as a function of time. The daily shale oil production is not quite proportional to oil shale grade being retorted. Therefore, it was concluded that the retorting zone was not horizontal but skewed so that it encountered a number of layers of formation particles of differing oil shale grade at the same time.

Monitoring the locus of a processing zone, such as a combustion zone or retorting zone advancing through the fragmented permeable mass 16 in the retort 10, has significant advantages. For example, steps can be taken to maintain the combustion zone flat and uniformly perpendicular to the direction of its advancement to minimize oxidation and excessive cracking of hydrocarbons produced in the retorting zone. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the compostion of and introduction rate of the retort inlet mixture.

Although this invention has been described in detail with reference to particular details and embodiments thereof, the particulars of the description are not intended to limit the invention, the scope of which is defined in the following claims:

What is claimed is:

1. A method for determining the locus of a retorting zone advancing through a fragmented permeable mass of particles containing oil shale in an in situ oil shale retort in a subterranean formation containing oil shale, said subterranean formation including a plurality of generally horizontal strata having differing kerogen contents, the method comprising the steps of:

forming an in situ oil shale retort containing a fragmented permeable mass of formation particles containing oil shale in the formation, the fragmented mass containing generally horizontal layers of particles corresponding to such strata;

determining kerogen content in at least one such layer in the fragmented mass;

predicting a production rate of shale oil from the kerogen content in said layer in the fragmented mass;

advancing a retorting zone through the fragmented mass for producing shale oil from kerogen in oil shale;

withdrawing shale oil from a lower portion of the fragmented mass;

determining a production rate of shale oil from the retort; and comparing such a determined production rate of shale oil from the retort with such a predicted production rate of shale oil for determining when the retorting zone advances through said layer.

2. A method as recited in claim 1 wherein the step of determining kerogen content comprises subjecting formation to the Fischer assay.

3. A method as recited in claim 1 wherein the step of advancing a retorting zone comprises introducing a retort inlet mixture to the retort and withdrawing an off gas from the retort, and the step of predicting comprises predicting a production rate of shale oil as a function of kerogen content and of the composition or rate of introduction, or both, of the retort inlet mixture.

4. A method as recited in claim 3 which comprises the further step of varying the composition or the rate of introduction of the retort inlet mixture, or both, as a function of the locus of the retorting zone.

5. A method for determining the locus of a retorting zone in a fragmented mass of formation particles containing oil shale in an in situ oil shale retort in a subterranean formation containing oil shale, the formation including a plurality of generally horizontal strata having differing kerogen contents, the method comprising the steps of:

forming an in situ oil shale retort having a fragmented permeable mass of formation particles containing oil shale, the fragmented mass containing generally horizontal layers of particles corresponding to such strata in the formation;

determining kerogen content in such formation at a plurality of elevations in the fragmented mass in an in situ oil shale retort for defining the loci of a plurality of such layers in the fragmented mass;

advancing a retorting zone through the fragmented mass for producing liquid products, the liquid products including shale oil generated from kerogen in such a retorting zone;

predicting production rate of shale oil in liquid products from the fragmented mass as a function of kerogen content of formation in such layers in the fragmented mass;

withdrawing liquid products from a lower portion of the fragmented mass;

measuring production rates of shale oil in liquid products withdrawn from the fragmented mass; and comparing such measured production rates of shale oil with such predicted production rates of shale oil for defining the locus of the retorting zone with respect to such layers in the fragmented mass.

6. A method as recited in claim 5 wherein the step of determining kerogen content comprises subjecting formation to the Fischer assay.

7. A method as recited in claim 5 wherein the step of advancing a retorting zone comprises introducing a retort inlet mixture to the retort and withdrawing an off gas from the retort, and the step of predicting comprises predicting production rates of shale oil as a function of kerogen content and of the composition or rate of introduction, or both, of the retort inlet mixture.

8. A method as recited in claim 7 which comprises the further step of varying the composition or the rate of introduction of the retort inlet mixture, or both, as a function of the locus of the retorting zone.

9. A method for determining the locus of a retorting zone advancing through a fragmented permeable mass of particles containing oil shale in an in situ oil shale retort in a subterranean formation containing oil shale, said subterranean formation including a plurality of generally horizontal strata having different contents of kerogen, the method comprising the steps of:

forming an in situ oil shale retort containing a fragmented permeable mass of formation particles containing oil shale in the formation, the fragmented mass containing generally horizontal layers of particles corresponding to such strata in the formation;

determining the kerogen content of formation as a function of elevation in the fragmented mass;

predicting cumulative production of shale oil as a function of elevation of a retorting zone from the determined kerogen content of formation as a function of elevation;

advancing a retorting zone through the fragmented mass for producing shale oil from kerogen in oil shale;

withdrawing shale oil from a lower portion of the retort;

determining cumulative production of shale oil from the retort; and comparing such a determined cumulative production of shale oil from the retort with such a predicted cumulative production of shale oil.

10. A method as recited in claim 9 wherein the step of determining kerogen content comprises subjecting formation to the Fischer assay.

11. A method as recited in claim 9 wherein the step of advancing a retorting zone comprises introducing a retort inlet mixture to the retort and withdrawing an off gas from the retort, and the step of predicting comprises predicting a cumulative production of shale oil as a function (a) of kerogen content as a function of elevation and (b) of the composition or the rate of introduction, or both, of the retort inlet mixture.

12. A method for determining the locus of a retorting zone advancing through a fragmented permeable mass of particles containing oil shale in an in situ oil shale retort in a subterranean formation containing oil shale, said subterranean formation including a plurality of generally horizontal strata having differing contents of kerogen, the method comprising the steps of:

forming an in situ oil shale retort containing a fragmented permeable mass of formation particles containing oil shale in the formation, the fragmented mass having generally horizontal layers of particles corresponding to such strata;

determining the kerogen content of formation at selected elevations for defining the loci of a plurality of such layers in the fragmented mass;

advancing a retorting zone through the fragmented mass for producing shale oil;

withdrawing shale oil from a lower portion of retort;

monitoring the production rate of shale oil withdrawn from the retort for variations corresponding to advancement of the retorting zone through such layers of formation particles in the fragmented mass; and correlating such variations in production rate of shale oil from the retort with differences in kerogen content of such layers of formation particles, whereby the locus of the retorting zone with respect to such layers of formation particles in the fragmented mass is determined.

13. A method as recited in claim 12 wherein the step of determining kerogen content comprises subjecting formation to the Fischer assay.

14. A method as recited in claim 12 wherein the step of correlating comprises plotting a graph of the kerogen content of formation as a function of elevation, plotting a graph of the production rate of shale oil as a function of time, and comparing the graphs.

15. A method for determining the locus of a retorting zone in a fragmented permeable mass of formation particles containing oil shale in an in situ oil shale retort in a subterranean formation containing oil shale, said formation including generally horizontal strata having different kerogen contents, the method comprising the steps of:

forming an in situ oil shale retort containing a fragmented permeable mass of formation particles containing oil shale in the formation, the fragmented mass containing generally horizontal layers of formation particles corresponding to such strata in the formation;

determining the kerogen content in formation at selected elevations for defining the loci of a plurality of layers of formation particles in the fragmented mass;

advancing a retorting zone downwardly through said plurality of layers in the fragmented mass for retorting oil shale therein for producing shale oil;

withdrawing shale oil from a lower portion of the fragmented mass;

monitoring the production rate of shale oil from the retort as a function of time for determining intermediate maxima and minima in such production rate corresponding to advancement of the retorting zone through said layers of formation particles in the fragmented mass; and correlating such intermediate maxima and minima in production rate of shale oil from the retort with intermediate maxima and minima in kerogen content of such layers of formation particles in the fragmented mass, whereby the locus of the retorting zone with respect to such layers of formation particles in the fragmented mass is determined.

16. A method as recited in claim 15 wherein the step of determining kerogen content comprises subjecting formation to the Fischer assay.

17. A method for determining if a retorting zone advancing through a fragmented permeable mass of particles containing oil shale in an in situ oil shale retort in a subterranean formation containing oil shale is substantially planar and substantially normal to its direction of advancement through the fragmented mass, said subterranean formation including a plurality of generally horizontal strata having differing kerogen contents, the method comprising the steps of:

forming an in situ oil shale retort having a fragmented permeable mass of formation particles containing oil shale, the fragmented mass having generally horizontal layers of particles of differing kerogen content corresponding to such strata in the formation;

determining kerogen content of formation at selected elevations in the retort before retorting;

predicting the first derivative of the production rate of shale oil versus time for advancement of the retorting zone through at least one such selected elevation;

advancing a retorting zone through the fragmented mass for producing shale oil from kerogen in oil shale;

withdrawing shale oil from a lower portion of the retort;

measuring the production rate of shale oil from such selected elevation;

determining the first derivative of the measured production rate of shale oil versus time; and comparing such a determined first derivative with such a predicted first derivative.

18. A method as recited in claim 17 wherein the step of determining kerogen content comprises subjecting formation to the Fischer assay.

19. A method for determining if a retorting zone advancing through a fragmented permeable mass of particles containing oil shale in an in situ oil shale retort in a subterranean formation containing oil shale is substantially planar and substantially normal to its direction of advancement through the fragmented mass, the formation including a plurality of generally horizontal strata having differing kerogen contents, the method comprising the steps of:

forming an in situ oil shale retort having a fragmented permeable mass of formation particles containing oil shale, the fragmented mass having generally horizontal layers of particles of differing kerogen content corresponding to such strata in the formation;

determining kerogen content at selected elevations in the retort before processing for defining the loci of a plurality of such layers in the fragmented mass;

predicting the first derivative of a production rate of shale oil in the liquid products versus time for advancement of the retorting zone through at least one such layer;

advancing a retorting zone through the fragmented mass for producing liquid products including shale oil generated from kerogen in such a retorting zone;

monitoring production rate of shale oil in liquid products from the retort;

determining the first derivative of the production rate of shale oil in the liquid products versus time for advancement of the retorting zone through said at least one such layer; and comparing the determined first derivative with such a predicted first derivative.

20. A method as recited in claim 19 wherein the step of determining kerogen content comprises subjecting formation to the Fischer assay.

* * * * *

UNITED STATES PATENT AND TRADEMARK OFFICE

CERTIFICATE OF CORRECTION

PATENT NO. : 4,150,722

DATED : April 24, 1979

INVENTOR(S) : Chang Y. Cha, William J. Bartel

It is certified that error appears in the above-identified patent and that said Letters Patent are hereby corrected as shown below:

In the Abstract, Line 13, "th" should be -- the --.

Column 5, Line 29, "January 11, 1976" should be -- November 1, 1976 --.

Signed and Sealed this

*Tenth* Day of *July 1979*

[SEAL]

*Attest:*

*Attesting Officer*

LUTRELLE F. PARKER

*Acting Commissioner of Patents and Trademarks*